US005898272A

United States Patent [19]

Mohacsi

[11] Patent Number: 5,898,272

[45] Date of Patent: Apr. 27, 1999

[54] CATHODE FOR GAS DISCHARGE LAMP

[75] Inventor: Ferenc Mohacsi, Muskego, Wis.

[73] Assignee: Everbrite, Inc., Greenfield, Wis.

[21] Appl. No.: 08/915,843

[22] Filed: Aug. 21, 1997

[51] Int. Cl.[6] ..... H01J 17/06

[52] U.S. Cl. ..... 313/632; 313/491; 313/633; 313/558; 313/352

[58] Field of Search ..... 313/490, 491, 313/631, 632, 633, 492, 558, 352, 355, 356

[56] References Cited

U.S. PATENT DOCUMENTS

| | | | |
|---|---|---|---|
| 3,351,797 | 11/1967 | Eckhardt et al. | 313/174 |
| 3,385,644 | 5/1968 | Della Porta et al. | 316/16 |
| 3,548,241 | 12/1970 | Rasch et al. | 313/178 |
| 3,579,459 | 5/1971 | Della Porta et al. | 252/181.4 |
| 3,719,433 | 3/1973 | Rabusin | 417/48 |
| 3,722,976 | 3/1973 | Porta et al. | 316/3 |
| 3,728,004 | 4/1973 | Waymouth | 316/4 |
| 3,733,194 | 5/1973 | Porta et al. | 75/5 |
| 3,768,884 | 10/1973 | Della Porta et al. | 316/25 |
| 4,157,485 | 6/1979 | Wesselink et al. | 313/174 |
| 4,516,945 | 5/1985 | Martelli | 445/19 |
| 4,535,267 | 8/1985 | Martelli et al. | 313/481 |
| 4,536,677 | 8/1985 | Pirota | 313/481 |
| 4,553,065 | 11/1985 | Pirota | 313/481 |
| 4,559,471 | 12/1985 | Kroontje | 313/553 |
| 4,577,136 | 3/1986 | Hooghordel et al. | 313/481 |
| 4,665,343 | 5/1987 | Ferrario et al. | 313/553 |
| 4,743,797 | 5/1988 | Emberson et al. | 313/422 |
| 4,835,441 | 5/1989 | Feller et al. | 313/553 |
| 4,859,905 | 8/1989 | White et al. | 313/558 |
| 4,910,430 | 3/1990 | Ito et al. | 313/566 |
| 4,940,300 | 7/1990 | Giorgi | 313/559 |
| 4,990,828 | 2/1991 | Rabusin | 313/546 |
| 5,256,935 | 10/1993 | Dobashi et al. | 313/491 |
| 5,312,607 | 5/1994 | Schiabel et al. | 423/210 |
| 5,461,281 | 10/1995 | Fromm et al. | 313/556 |
| 5,572,088 | 11/1996 | Aizawa et al. | 313/491 |

FOREIGN PATENT DOCUMENTS

| | | |
|---|---|---|
| 2142003 | 2/1995 | Canada . |
| 2152241 | 6/1995 | Canada . |
| 0 359 724 | 3/1990 | European Pat. Off. . |
| 0436477A2 | 12/1990 | European Pat. Off. . |
| 62-094993 | 1/1987 | Japan . |
| 2-304855 | 12/1990 | Japan . |
| 06302267 | 10/1994 | Japan . |
| 1725288 | 4/1992 | U.S.S.R. . |
| 2056490 | 7/1980 | United Kingdom . |
| 2 091 481 | 7/1982 | United Kingdom . |

OTHER PUBLICATIONS

Electron Emission, pp. 3–6, 3–7;3–118, 3–119, 3–120,3–121.

The SAES Getters Group brochure, Nov., 1994.

*Primary Examiner*—Nimeshkumar D. Patel

*Attorney, Agent, or Firm*—Michael Best & Friedrich LLP

[57] ABSTRACT

The cathode for a gas discharged lamp includes gettering materials which are placed within the interior of the cathode shell. Other components may also be placed inside the cathode for continuous activation. For example, in mercury vapor lamps, a mercury amalgam is placed within the cathode. In another embodiment, a mass of electron emission assisting compound is placed within the cathode to replenish the emission assisting compound which deteriorates from the cathode.

27 Claims, 1 Drawing Sheet

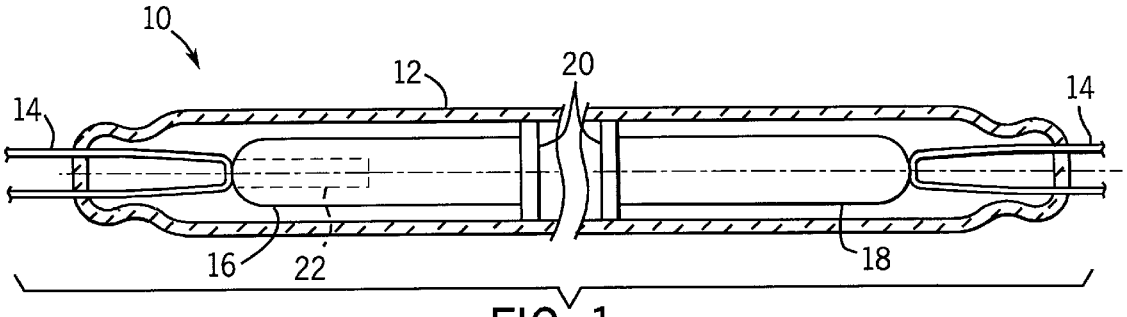
FIG. 1
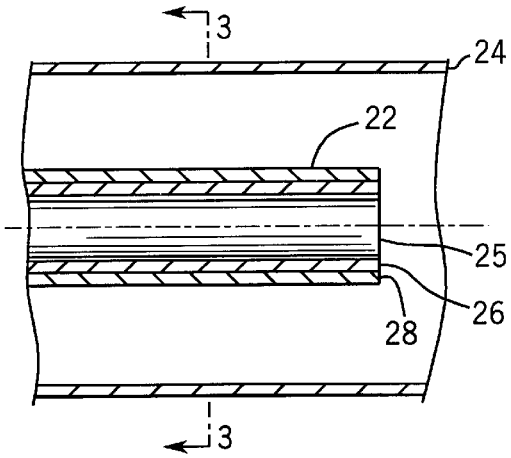
FIG. 2
FIG. 3
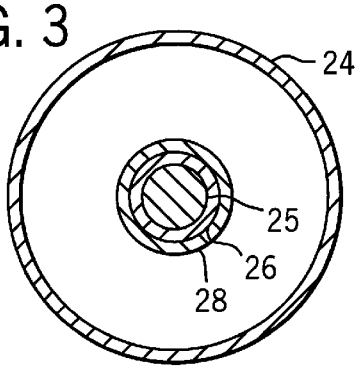
FIG. 4
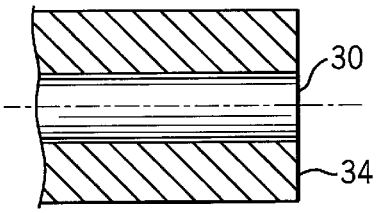
FIG. 5
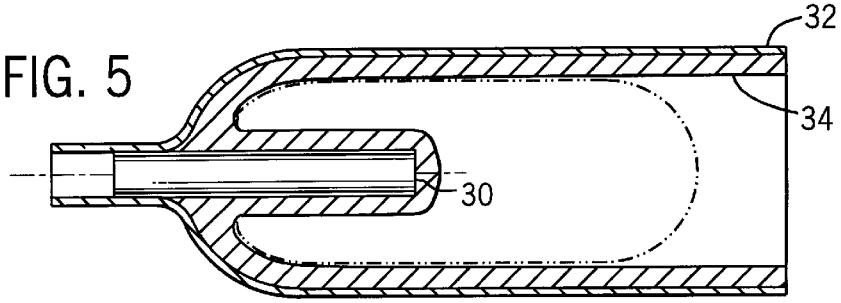

CATHODE FOR GAS DISCHARGE LAMP

BACKGROUND OF THE INVENTION

The present invention relates to cathodes for use in gas discharge lamps. More particularly, the invention relates to cold cathodes used in low pressure gas discharge lamps.

Gas discharge lamps operate by passing a flow of electrons through a gaseous environment. The electron current flow is driven by a voltage potential across the electrodes. Cold cathode type lamps rely on surface electron emission to provide the electrons and to initiate the flow of electric current. A relatively large voltage potential is required to initiate electron flow. The voltage required depends upon the density of the gas within the lamp. As commonly known, high pressure discharge lamps are filled with gas at atmospheric pressure or higher. Low pressure discharge lamps are filled with gas typically at 0.500 atmospheres or less. Further, electron flow is related to the surface area of the cathode.

It is known in the art to provide a cathode which is substantially cylindrical, thereby increasing the surface area available for electron emission. Also, to reduce the cathode's physical size and improve lamp efficiency, the inside of the cylinder is coated with a compound which is capable of enhancing the availability of free electrons. Such an emission assisting coating greatly enhances current flow per square inch of available electrode.

When electric current is passing through the gas in the lamp, some of the electrons will collide with atoms of the gas, passing energy to the atoms at different levels depending on the type of collision. In elastic collisions, the electrons essentially bounce off the gas atoms and transfer some of their kinetic energy to the gas atoms. In excitation collisions, the electrons collide with a gas atom in such a way that one or more of the atom's electrons are moved to a higher energy level but without leaving the atom's influence. Almost instantaneously, the displaced electron will return to its ground state, releasing the excess energy it picked up as the result of the collision, some of which is visible light. At still higher energy levels, the high velocity electrons collide with gas atoms with sufficient force to liberate one or more of the gas atom's electrons. The freed electrons become part of the electric current, and flow towards the positively charged anode. Positively charged gas ions are attracted to the negatively charged cathode, and combine with free electrons if they can.

Thus, some positively charged gas ions will exist in the envelope of the lamp. If they are sufficiently close to the negatively charged cathode, they will not have time to pick up an electron, and they will accelerate toward the cathode. The area of space where positive ions accelerate towards the negatively charged cathode is commonly known as the negative column. If the cathode of the lamp is a shell type with a sidewall forming an interior, then the negative column may be within the interior of the cathode shell. When the gas ions collide with the cathode, they have sufficient kinetic energy to vaporize a small part of the cathode material, causing gradual erosion of the cathode. This process of erosion is commonly known as sputtering.

Cold cathode type low pressure gas discharge lamps, commonly called neon lamps, are well known, popular, and attractive lamps for custom display applications. Unfortunately, lamps using such cathodes suffer from several disadvantages. First, they are expensive to produce because of time and energy consuming processing techniques. The lamps are sensitive to various sorts of contaminants, and such sensitivity necessitates the use of expensive processing techniques to minimize the amount of contaminants in the lamp after manufacturing.

The first of such techniques, commonly called bombarding, involves passing a current substantially larger than the operating current of the lamp through a partially evacuated lamp. The purpose of this procedure is to remove impurities such as moisture from the glass wall and to oxidize and thereby activate the emission-assisting coating of the cathode. Impurities such as moisture or oxygen can be harmful to the lamp. In addition, the oxidization of the emission coating of the cathode releases some carbon dioxide which can also be a harmful contaminant. After heating, the lamp is usually back-flushed with an inert gas to dilute or remove whatever harmful gases are left in the lamp envelope after the bombarding process. Subsequently, the operating gases are placed inside the lamp. Processing equipment for bombardment can be relatively simple, but in recent times, because of quality expectations, equipment has become more and more sophisticated, and thus more expensive. Further, the procedure requires a significant amount of energy and increases processing time.

An alternative process, known as oven pumping, is used less frequently. Oven pumping involves heating the glass in a specially designed oven under relatively high vacuum. Gases which evolve during the heating are continuously removed. Once the glass becomes relatively cold, the electrodes are heated with radio frequency heaters, flushed and back-filled. Again, this process adds time and expense to the manufacturing of gas discharge lamps.

Neither process guarantees a uniformly repeatable result. The final vacuum, and therefore the purity of the lamp environment, is dependent upon time, volume, and gas flow restriction. By their nature, cold cathode low pressure lamps are often intended for custom applications and therefore the results of such processes may vary considerably.

Such lamps also suffer from a reduced life span for various reasons. First, the active gas within the lamp may be lost. The vast majority of gas losses are due to absorption by the cathodes. When gas ions collide with the cathode at high velocity, they have a high probability of being accelerated into the cathode and embedding into the surface of the cathode. Second, the cathode itself may be eroded by sputtering. Such high velocity gas ions often transfer their kinetic energy to the metal causing a very high localized temperature, thereby vaporizing some of the metal particles of the cathodes which condense nearby. Such sputtering removes the emission assisting coating within the cathode as well as the metal of the cathode itself. The sputtering continues through the lamp's life until the cathode erodes to such a degree that it is incapable of providing the free electrons needed to maintain the current flow. Third, phosphors, which are required in order to radiate light in the visible spectrum, may combine with contaminants in the lamp, thereby reducing the radiation efficiency of the lamp.

Existing lamps address these problems by several means which are expensive or limited in efficacy. A gettering material, a material which may absorb gaseous contaminants, may be placed within the glass envelope of the lamp to remove some impurities which were not removed in the initial manufacturing. Such a getter is commonly a solid block, and therefore will be limited in efficacy by the surface area of the solid. More commonly, manufacturers simply utilize more elaborate and precise processes of removing contaminants. Such processes add expense and time to the manufacturing process. Additionally, they are limited in efficacy because contaminants are still found in the lamp, and because erosion of lamp components still takes place.

SUMMARY OF THE INVENTION

In light of these problems, the present invention has as its primary features and advantages the reduction of the processing costs of gas discharge lamps as well as an increase of the lamp's life.

The present invention utilizes the sputtering effect of the high velocity gas ions in order to provide continuously replenishing lamp components. By placing various components within the interior of the cathode, such components are continuously eroded by the high velocity gas ion stream and thus provide a surface which is continuously active.

In the present invention, gettering materials are placed within the interior of the cathode shell, thereby providing a surface which is slowly and continuously eroded and thereby continuously active. Such a getterer remains active through the life of the lamp. Because a contaminants are a primary reason for processing expense, as well as reduced lifetime of the lamp, the continuously active getter helps in relieving both problems.

In several embodiments of the invention, other components are placed inside the cathode for continuous activation. Incorporating a substance which contains the active gas into the cathode continuously replenishes the gas supply. For example, in lamps involving mercury vapor, a mercury amalgam is placed within the cathode for continuous replenishment. In another embodiment, a mass of electron emission assisting compound is placed within the cathode in order to replenish the emission assisting compound which deteriorates from the cathode.

Incorporating a mercury amalgam into the sputterable mass also reduces the amount of liquid mercury which must be used in production of the lamps. This increases the safety of the workers handling the mercury, and the lamps in production, and adds to the ease and convenience of manufacturing.

When gas discharge lamps, and in particular cold cathode type low-pressure gas discharge lamps are manufactured using a cathode according to the present invention, the necessity of expensive processing techniques to precisely and carefully remove minute traces of contaminants is relieved. Further, contaminants are continuously removed over the course of the lifetime of the lamp and therefore the lifetime is expected to be greatly enhanced. Also, other necessary components of the lamp itself, such as the active gases and the emission assisting material within the cathode, are replenished over the lifetime of the lamp thereby extending the lamp's life.

These and other features and advantages of the present invention will be apparent to those skilled in the art from the following detailed description of several embodiments and the drawings, in which:

BRIEF DESCRIPTION OF THE DRAWINGS

In the appended figures,

FIG. 1 is a cross-sectional side view of a cold cathode gas discharge lamp according to the present invention.

FIG. 2 is a cross-sectional side view of portion a cathode according to a first embodiment of the invention.

FIG. 3 is a cross-sectional end view of a cathode according to the first embodiment of the invention, taken along line 3—3 of FIG. 2.

FIG. 4 is a cross-sectional side view of a cylindrical mass within the cathode according to a second embodiment of the invention.

FIG. 5 is a cross-sectional side view along the of a cathode according to the second embodiment of the invention.

DETAILED DESCRIPTION OF THE PREFERRED EMBODIMENTS

FIG. 1 shows a cold cathode low pressure type gas discharge lamp 10 which may use the electrode of the present invention. An envelope 12 is generally cylindrical in shape, and houses other components of the lamp 10. The cross-sectional shape of such lamps is generally round, but may be of different forms. Additionally, the envelope 12 may be formed into rings or other curves, or made in the shape of letters for custom applications. The envelope 12 is conventionally made of glass. The envelope 12 should have the characteristics of being transparent to the visible spectrum, impermeable to gases, and being an electrical insulator. Other materials such as certain plastics may be possible to use, but at present are not commonly used.

Inserted through the envelope and to the electrode are the lead wires 14. The lead wires 14 extend from the sealed lamp 10 to a power source or the like. Lead wires may be made of nickel or other suitable material. The point of insertion of the lead wires 14 through the envelope 12 is hermetically sealed.

The volume of the envelope will be filled with gases which radiate light when a current is forced across them. Gases which are primarily responsible for radiation of light are referred to as active gases. Some gases, such as mercury vapor, have very low vapor pressure at a typical cold-cathode lamp's operating temperature and pressure, and therefore require a carrier gas. Typically, carrier gases are argon or a mixture of argon and neon.

Several different types of active gases are possible. In low pressure cold cathode type lamps, mercury vapor is predominantly used. Neon is less frequently used. In other types of gas discharge lamps, possible active gases include helium, sodium, and argon. The gas pressure may be approximately one atmosphere in what is commonly known as a high pressure gas discharge lamp. In what is commonly known as a low pressure gas discharge lamp, the gas pressure will typically be less than one atmosphere.

The inside surface of the envelope 12 may be coated with phosphors. Phosphors are high purity crystalline inorganic compounds doped with activators to enable them to absorb radiated energy and re-emit it at a longer wavelength. In the case of mercury vapor, the phosphors' peak absorption is at about 253.7 nm and the emission can be anywhere in the visible spectrum. In effect, phosphors on the inside of the envelope absorb UV radiation and radiate it in different wavelengths of the visible spectrum. Deterioration of the phosphors decreases the emission efficiency of the lamp. Commonly used phosphors include calciumhalophosphates, barium magnesium aluminate, zinc silicate, yttrium oxide, and magnesium fluorogermanete. Each type of phosphor has a different characteristic range of emission wavelengths, and therefore is used in different color lamps.

The electrodes 16 and 18 are placed within the envelope 12 at opposite ends. The cathode 16 is the negatively charged electrode, and the anode 18 is the positively charged electrode. The cathode 16 and anode 18 are operatively positioned within the envelope by the centering rings 20. The cathode 16 may be composed of a metal shell, such as nickel-plated soft iron, stainless steel or other suitable material. The centering rings 20 may be made of a ceramic or other suitable material.

Cathodes in low pressure gas discharge lamps may be of at least two types, including hot cathode and cold cathode. Hot cathode refers to cathodes maintained at an elevated temperature, sufficient to provide thermionic electron emission. Cold cathode refers to cathodes which rely upon surface electron emission to provide the electrons to initiate current flow within the gas. The embodiments shown are cold cathode type electrodes.

As shown by way of example by the dashed line in FIG. 1, the cathode may contain several elements. The dashed line represents a possible configuration of a mass 22 of material positioned within the cathode shell 24 according to the present invention. FIGS. 2 and 3 depict a first embodiment of the invention, which may correspond to the cathode 16 of FIG. 1. In FIG. 2, a mass 22 extends within the shell 24 of the cathode 16. Such a mass may be cylinder-shaped for symmetrical placement within a cylindrical lamp and for ease of manufacturing. The mass 22 is composed of several layers of materials. FIG. 3 depicts a cross-section along line 3—3 of FIG. 2, of the mass 22 composed of various layers.

Such a cathode for a cold-cathode type gas discharge lamp may have many possible shapes. The rate of electron emission is directly related to the available surface area of the electrode. Therefore, it is known to use an open cylindrical shape within a cylindrical lamp in order to increase the effective surface area. However, alternative geometries of the cathode may still embody the principles of the invention. For example, it is possible to include a conical cathode with a gettering means in the interior of the cathode. The sputtering of the gettering means would still allow the getter to be continuously active. There are many possible geometries of other components within the cathode shell 24 also.

In the present invention, FIGS. 1–5 show a cathode 16 formed of a single sidewall into a shell 24 with an open cylinder shape. Electrons and ions flow between the interior of the shell 24 through the opening, to other portions of the lamp 10 inside the envelope 12. Such a cathode has a longitudinal axis, as shown in FIGS. 1, 2, 4 and 5. As in the embodiments shown, the mass 22 within the cathode 16 may be of any appropriate geometry, and comprise several components. Such a mass may be an elongated shape, such as a cylinder in the present embodiment, and have a longitudinal axis as indicated in FIGS. 1, 2, 4 and 5. In the embodiments shown, the two axes are coincident, but other configurations are possible.

In FIGS. 2 and 3, the core of the mass 22 is comprised of a gettering means 25. The gettering means 25 is a material which is capable of absorbing gaseous contaminants within the lamp 10. Gases such as oxygen and hydrogen are highly reactive and considered to be major contaminants. There are, however, many types of gaseous contaminants. Some radiate a great level of heat-reducing energy as well as increase gas pressure, resulting in a further reduction of efficiency. Other gases may form undesirable compounds. Still other gaseous materials may alter the desired spectral distribution of the lamps. Because gaseous contaminants can have so many harmful effects, including reducing the lifetime and efficiency of the lamps, they must be carefully removed. Precisely and carefully removing undesirable gases is energy-consuming, time-consuming, and expensive. Also, because the low pressure cold cathode type lamps are often for custom applications, results may be inconsistent. The processes themselves, such as bombarding and oven-pumping, do not guarantee uniformly repeatable results. Because the invention allows the use of less stringent manufacturing techniques, lamps using such a cathode may be made less expensive and last longer.

Getters come in many forms and can be tailored to absorb different types of contaminants. Zirconium-based getters are most commonly used in this application. In the past, some attempts have been made to introduce the use of gettering, but it added material cost and increased processing time as well, which resulted in unacceptable cost increases relative to increase in performance.

Referring again to FIGS. 2 and 3, the intermediate layer 26 is comprised of a material which is capable of releasing the active gas of the lamp 10. In the case of mercury-vapor, for example, a solid amalgam of mercury may be used. In mercury vapor lamps, use of a mercury amalgam has additional advantages. Placing a mercury amalgam within the cathode in this manner reduces the amount of liquid mercury which must be handled during the manufacturing process. Because mercury is a dangerous and toxic substance for humans and animals, this creates a safer environment.

The outer layer 28 is comprised of an emission-assisting coating. Such a coating is conventionally placed on the inner surface of the cathode in a shell-type cathode. Emission-assisting compounds typically contain barium, strontium, or calcium. They are small particles which coat the inner surface of the cathode and thereby increase the effective area and current flow. For example, typically bare metal is capable of providing 7 mA of current per square inch. A 30 mA cathode would require 4.5 square inches of electron emitting surface, which would be bulky and inconvenient. Use of an emission-assisting material can increase the current per square inch output about 5 to 7 times, thereby increasing efficiency and making physical placement of the cathode within smaller lamps possible. Placing such an emission-assisting material within a mass 22 disposed inside the cathode 16 allows the emission-assisting material to be continually available by action of the sputtering. As the mass 22 is sputtered away, the emission-assisting material 28 will be distributed about the inner surface of the cathode shell 24.

As shown in this first embodiment and the second embodiment, such a mass 22 may have many possible configurations. Where the gettering means 25 includes a mass 22 having first and second portions, the second portion may include an emission-assisting material, an active gas-releasing material, or other appropriate materials. The second portion may be layers, such as the intermediate layer 26 and outer layer 28 as shown in FIG. 2. However, the second portion may be disposed in any appropriate orientation with respect to the first portion. For example, the gettering means may comprise the outer portion of the mass, and other components may be disposed within an inner portion of the mass. Such a configuration is similar to the rod of FIG. 2, except the components would be in different locations. The outer layer 28 would be a first portion comprising the gettering means 25. The inner portion would then be the second portion comprising another material, such as an emission-assisting material or an active gas-releasing material, of the mass 22.

A second embodiment of the invention is shown in FIGS. 4 and 5. In the second embodiment, a cylindrical rod 30 of a gettering means is positioned along the longitudinal axis of the cathode shell 32. A substantially uniform coating 34 extends over the cylindrical rod 30 of gettering means and the inner surface of the cathode shell 32. Such a coating 34 comprises a mixture of an active gas-releasing material and an emission-assisting material. The dashed line FIG. 5 roughly illustrates the volume of the negative column, in which high velocity ions will sputter materials.

It will be apparent to those skilled in the art that other embodiments of the present invention are possible. The various materials, a gettering means, an emission-assisting material, and an active gas-releasing material, may be mixed together in different combinations and relative amounts. They may be disposed within a mass which may be disposed within the cathode in various geometries. In the first and second embodiments shown, a cylindrical mass extending along the longitudinal axis of the cathode shell is shown. However, such a mass may be in any appropriate geometry, tailored to the particular cathode, or desired erosion characteristics, or manufacturing considerations, or otherwise. In addition, as the second embodiment illustrates, such a mass may also be coated along the inner surface of the cathode shell.

While several embodiments of the present invention have been shown and described, alternate embodiments will be apparent to those skilled in the art and are within the intended scope of the present invention. Specifically, the invention could be implemented with different types of lamp components placed inside the cathode shell in various configurations. Therefore, the scope of the invention is to be limited only by the following claims.

I claim:

1. An electrode for use in a gas discharge lamp, comprising:

a shell including at least one sidewall defining an interior and including an opening; and a getter that getters contaminants in said lamp, said getter being disposed in the interior of said shell and said getter being disposed in a substantially solid mass of material that does not contact said sidewall.

2. The electrode of claim 1 further comprising:

an emission-assisting material disposed within said interior.

3. The electrode of claim 1 further comprising:

an active gas-releasing material disposed within said interior.

4. The electrode of claim 1 further comprising:

an emission-assisting material disposed within said interior; and an active gas-releasing material disposed within said interior.

5. The electrode of claim 1 wherein:

said shell has a longitudinal axis, and wherein said mass includes an elongated member that is substantially parallel to said longitudinal axis.

6. The electrode of claim 1, wherein:

said shell has a longitudinal axis, and wherein said mass includes an elongated member that is substantially parallel to said longitudinal axis.

7. The electrode of claim 1, further comprising:

a mass of material having a first portion that includes said getter, and having at least one second portion made from a material other than a gettering material.

8. The electrode of claim 7, wherein:

said first portion defines a substantially outer portion and said second portion defines a substantially inner portion.

9. The electrode of claim 7 wherein said second portion includes:

an emission-assisting material disposed within the interior of said shell.

10. The electrode of claim 7 wherein said second portion includes:

an active gas-releasing material disposed within the interior of said shell.

11. The electrode of claim 7 wherein said second portion includes:

an emission-assisting material disposed within the interior of said shell; and an active gas-releasing material disposed within the interior of said shell.

12. The electrode of claim 7 wherein:

said mass is composed of a plurality of layers of said getter and the other materials of said second portion.

13. The electrode of claim 7 wherein:

said shell has a longitudinal axis;

said first portion of said mass includes an elongated member that is substantially parallel to said longitudinal axis; and said second portion includes a substantially uniform layer disposed over at least part of said sidewall.

14. The electrode of claim 7 wherein:

said mass is composed of a mixture of said getter and the other materials of said second portion.

15. The electrode of claim 1 wherein:

said member includes an outer portion and an inner portion;

said outer portion includes said getter; and said inner portion includes at least one of said active gas-releasing material and said emission-assisting material.

16. The electrode of claim 1 wherein said mass is centrally-disposed within the interior of said shell.

17. The electrode of claim 1 wherein said shell and said mass are both cylindrical in shape.

18. An electrode for use in a gas discharge lamp, comprising:

a shell including at least one sidewall defining an interior and including an opening; and a substantially solid mass of material capable of releasing active gas in said lamp, said active gas-releasing material disposed in the interior of said shell such that said mass does not contact said sidewall.

19. The electrode of claim 18 wherein said solid mass includes:

an emission-assisting material.

20. The electrode of claim 18 wherein:

said shell has a longitudinal axis, and wherein said mass includes an elongated member that is substantially parallel to said longitudinal axis.

21. An electrode for use in a gas discharge lamp, comprising:

a shell including at least one sidewall defining an interior, said shell also having a shell longitudinal axis and including an opening; and a member disposed within the interior of said shell and having a member longitudinal axis that is substantially parallel to said shell longitudinal axis, said member including:

a getter that getters contaminants, wherein said member is disposed in said shell such that said member does not contact said sidewall.

22. The electrode of claim 21 wherein:

said member further includes an emission-assisting material and an active gas-releasing material.

23. The electrode of claim 22 wherein:

said member includes a layer of said getter, a layer of said emission-assisting material, and a layer of said active gas-releasing material.

24. The electrode of claim 22 wherein:

said member includes a mixture of said emission-assisting material and said active gas-releasing material.

25. The electrode of claim 21 further comprising:

a layer disposed on at least a portion of an inside surface of said sidewall, said layer including a mixture of an emission-assisting material and an active gas-releasing material.

26. The electrode of claim 21 wherein said member is centrally-disposed within the interior of said shell.

27. The electrode of claim 21 wherein said shell and said member are both cylindrical in shape.

* * * * *